US007010931B2

(12) United States Patent
Lee

(10) Patent No.: US 7,010,931 B2
(45) Date of Patent: Mar. 14, 2006

(54) NANOCLIMATE CLOTHING AND APPAREL

(76) Inventor: Clemie Lee, 5585 Mountain Crescent, Stone Mountain, GA (US) 30087-5273

( * ) Notice: Subject to any disclaimer, the term of this patent is extended or adjusted under 35 U.S.C. 154(b) by 329 days.

(21) Appl. No.: 10/665,072

(22) Filed: Sep. 22, 2003

(65) Prior Publication Data

US 2004/0055072 A1 Mar. 25, 2004

Related U.S. Application Data

(60) Provisional application No. 60/411,929, filed on Sep. 20, 2002.

(51) Int. Cl.
*F25D 23/12* (2006.01)

(52) U.S. Cl. ..... 62/259.3; 62/457.2; 62/530

(58) Field of Classification Search ..... 62/259.3, 62/457.1, 457.2, 371, 530; 165/46
See application file for complete search history.

(56) References Cited

U.S. PATENT DOCUMENTS 3,743,012 A * 7/1973 Laxo ..... 165/101
4,138,743 A 2/1979 Elkins et al.
4,204,543 A 5/1980 Henderson
4,326,533 A 4/1982 Henderson
4,484,363 A 11/1984 Varanese
4,854,319 A 8/1989 Tobin
5,060,833 A * 10/1991 Edison et al. ..... 224/148.2
5,197,292 A 3/1993 McPherson
5,539,934 A 7/1996 Ponder
5,557,807 A 9/1996 Hujar et al.
5,940,880 A 8/1999 Phillips
6,176,869 B1 * 1/2001 Mason et al. ..... 607/104
6,481,021 B1 11/2002 Spell
6,526,761 B1 * 3/2003 Robbie et al. ..... 62/45.1
6,539,979 B1 * 4/2003 Driver ..... 138/98

* cited by examiner

*Primary Examiner*—Melvin Jones

(57) ABSTRACT

A temperature control system adapted for use with an article of clothing and designed to cool the wearer of the article of clothing. The temperature control system comprises a canister containing a cooling agent in its gaseous or vaporous state, a regulator for adjusting the flow of cooling agent from the canister and at least one supply line for delivering the cooling agent to an optimal release point. The canister can be an integral part of the article of clothing adapted to be recharged with the cooling agent or can be removable from the article of clothing, adapted to be refilled and replaced. The at least one supply line can be a plurality of supply lines delivering cooling agent to several optimal release points located within the article of clothing. The regulator enables the user to adjust the amount of cooling agent in order to obtain an optimal level of comfort. The temperature control system can be incorporated into any type of clothing article or apparel, including shirts, pants, blouses, footwear (shoes and boots), headgear (caps, hats, helmets), gloves and belts.

20 Claims, 4 Drawing Sheets

Fig. 1-A
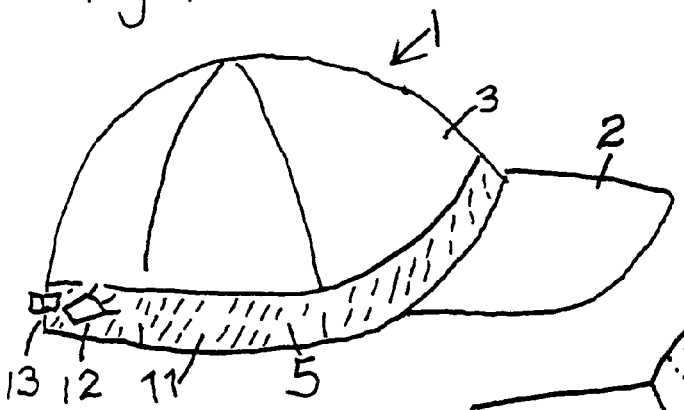
Fig. 1-B
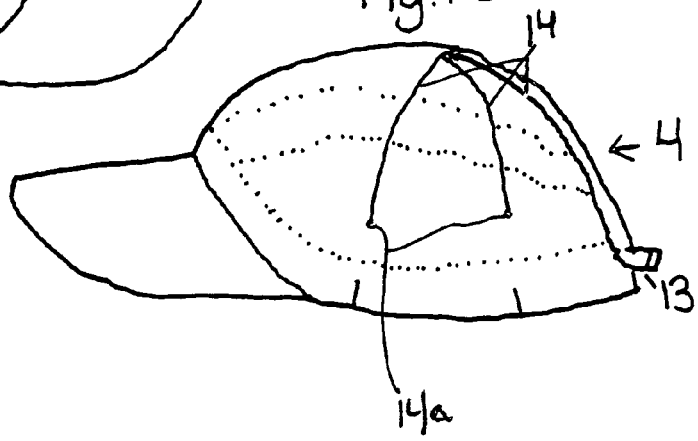
Fig. 1C
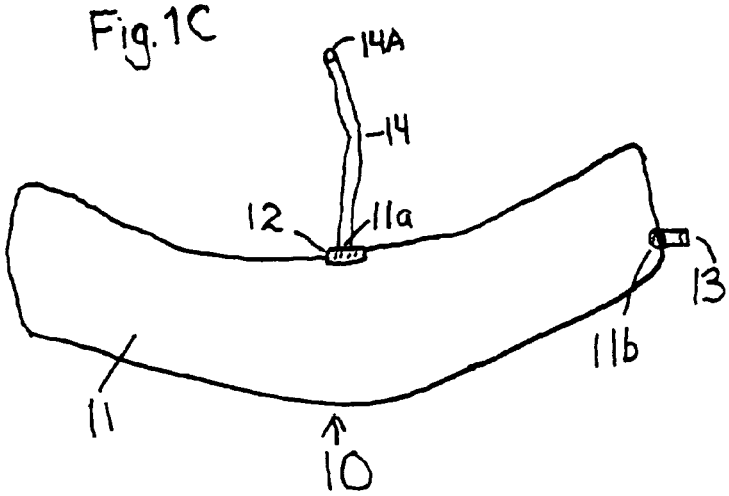

NANOCLIMATE CLOTHING AND APPAREL

RELATED APPLICATIONS

This application claims the benefit of priority of U.S. patent provisional application Ser. No. 60/411,929, filed in the United States Patent & Trademark Office on Sep. 20, 2002 by the named inventor.

FIELD OF INVENTION

The present invention relates to nanoclimate clothing articles, that is clothing or apparel which is provided with temperature control means. More particularly, the present invention relates to clothing and apparel articles having a user-activated and adjustable temperature control means incorporated within the clothing article.

BACKGROUND OF THE INVENTION

Man has acclimated to his environment throughout the ages by adopting suitable shelter and clothing. In modern times, indoor environmental systems are of significant importance to those that live in harsh climates, particularly torrid or frigid climates. In addition, the type and amount of clothing worn is a critical requirement to those who venture outdoors. Sometimes, outdoor activities are planned during the more moderate temperature of the day, such as early morning or late evening. However, it often is required to be outdoors during the most inhospitable time of day which can lead to adverse medical reactions caused by prolonged exposure to harsh weather conditions. Consequently, taking the air-conditioned comfort or warmth typically associated with an indoor environmental system with us to the outside is a particularly appealing concept.

The prior art is replete with efforts to incorporate indoor environment systems within clothing articles. For example, U.S. Pat. No. 4,204,543 to Henderson, issued May 27, 1980, discloses a coolant band having a pocket in which a bag of freezable liquid or semi-liquid material may be inserted. The band may be worn on the head or about the body to provide a cooling effect. Similar bands are disclosed in U.S. Pat. No. 4,326,533 to Henderson, issued Apr. 27, 1982 and in U.S. Pat. No. 4,854,319 to Tobin, issued Aug. 8, 1989.

U.S. Pat. No. 4,484,363 to Varanese, issued Nov. 27, 1984, provides a cap which utilizes a removable cooling device in the forehead area of a cap. The cooling device is in the form of a sealed bag or container constructed from a water-impermeable material and containing a liquid or semi-liquid gel-like substance. U.S. Pat. No. 5,539,934 to Ponder, issued Jul. 30, 1996, discloses a protective helmet having a coolant bladder attached to the helmet and covering the entire cranium crown, the coolant bladder being filled with a ammonium-based fluid coolant. Similar devices for cooling headgear are disclosed in U.S. Pat. No. 4,138,743 to Elkins et al., issued Feb. 13, 1979 and U.S. Pat. No. 5,557,807 to Hujar et al., issued Sep. 24, 1996. All of the above-mentioned patents require that the bladder be filled with a fluid or gel based coolant, such as water or glycol, that is cooled in a refrigerator, freezer, or ice chest. A significant drawback to these cooling head gear is exposing the wearer to possible harm from the skin contact with a frozen substance. In addition, none of these patents enable the user to adjust the cooling level of the head gear. Moreover, the use of a chilled or frozen fluid-filled bladder creates unnecessary weight on the user's head which can create extreme discomfort to the wearer.

Several attempts have been made to design cooling headgear based upon evaporative principles. For example, U.S. Pat. No. 6,481,021 to Spell, issued Nov. 19, 2002, and U.S. Pat. No. 5,197,292 to McPherson, issued Mar. 30, 1993, provide articles of headgear, each having a small pouch attached to the rearward portion of a cap in which ice can be placed. As the ice melts, cool water runs down the neck and back of the wearer, providing him with cooling relief. One disadvantage to the type of headgear disclosed by Spell and McPherson is that water drips on the wearer, wetting clothing and making it impractical for many uses. Another disadvantage is that the user cannot adjust the cooling level; rather, the ice melts based upon ambient temperature.

In U.S. Pat. No. 5,940,880 to Phillips, an apparatus and method for providing coolant water to the head of a user during exercise is described, in which the user can control the amount of coolant (ice water) being delivered by means of a hand pump which conducts water from a bladder to an irrigation system disposed about the user's head. Like the Spell and McPherson patents, the Phillips device has limited use insofar as the user will get wet when the device is in operation. Moreover, the Phillips apparatus requires an air bladder and a water container which is carried on the user's back, as well as an elaborate irrigation system for wetting the user with cooled water. Finally, none of the cooling devices disclosed in the aforementioned patents can be easily incorporated into other articles of clothing.

Despite the attempts of the prior art, a need still exists for a cooling system for clothing articles that does not require placing the cooling source into a refrigerator, freezer, or ice chest. Such a system should utilize a gas or vapor based cooling agent, rather than a water or fluid based cooling agent which adds unnecessary weight and bulk. Such a system also should be lightweight and comfortable for long periods of wear. In addition, such a system should be rechargeable quickly and easily, such as from an aerosol can. Further, such a system should be designed in such a manner than it can be effectively used in all forms of clothing and apparel. Moreover, such a system should provide the wearer with the ability to instantly adjust the cooling level. Also, such a system should employ the use of water-proofing polymers and/or vapor impermeable polymers on the outside fabric in order to contain and improve the effectiveness of the cooling agent.

SUMMARY OF THE INVENTION

Accordingly, it is an object of the present invention to provide nanoclimate clothing articles which utilize a gas or vapor based cooling agent, rather than a heavy water or fluid based cooling agent.

It is another object of the present invention to provide nanoclimate clothing articles which are lightweight and comfortable for long periods of wear.

It is an additional object of the present invention to provide nanoclimate clothing articles in which the cooling system can be recharged quickly and easily.

It also is an object of the present invention to provide nanoclimate clothing articles in which the cooling system can be recharged by means of an aerosol can.

It is a further object of the present invention to provide nanoclimate clothing articles in which the cooling system can be quickly and easily recharged by replacement of a cooling agent canister.

It is yet another object of the present invention to provide nanoclimate clothing articles which enable the user to instantly adjust the amount of cooling agent being delivered to the clothing article.

It is an additional object of the present invention to provide a cooling system which can be used effectively in all forms of clothing articles.

It is another object of the present invention to provide nanoclimate clothing articles which employ water-proofing polymers and/or vapor impermeable polymers on the outside fabric in order to contain and improve the effectiveness of the cooling agent.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein:

FIG. 1A is an exterior side view of a nanoclimate clothing article of the present invention in the form of a cap.

FIG. 1B is an interior side perspective view of a nanoclimate clothing article of the present invention in the form of a cap.

FIG. 1C is a rear view of a nanoclimate clothing article of the present invention in the form of a cap.

DETAILED DESCRIPTION

Figure 2:
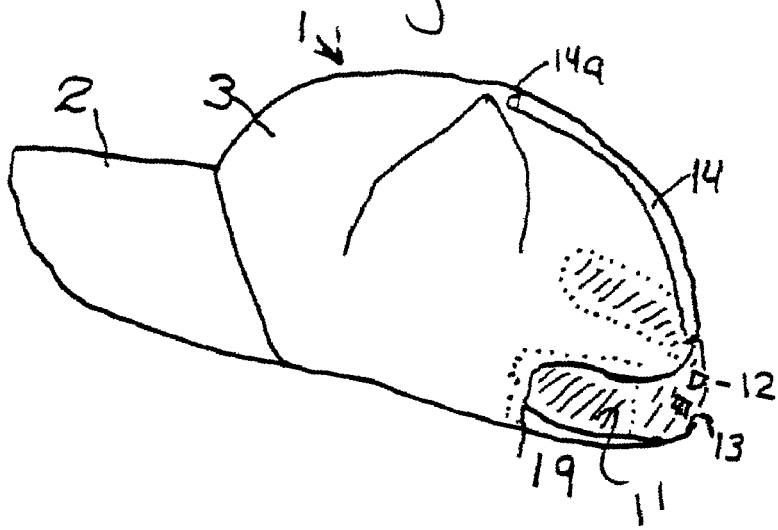
FIG. 2 is a perspective view of the cooling system for the nanoclimate clothing article of the present invention.

The present invention relates to nanoclimate clothing articles which incorporate the convenience and comfort associated with indoor environmental systems. It is to be understood that throughout this specification and claims, the term "clothing articles" broadly encompasses any type of article which can be worn, including headwear, footwear, belts, shirts, trousers and the like. Referring now to FIGS. 1A, 1B and 1C, a nanoclimate article in the form of a cap 1 is shown. Cap 1 comprises a visor 2, a crown having a front area 3, a rear area 4, side areas 5 and a cooling system 10 comprising a canister or bladder 11, a regulator 12, a refill valve 13 and at least one supply line 14. More specifically, the canister 11 of the cooling system has an outlet valve 11*a* which is connected to the regulator 12 and which is in fluid communication with the at least one supply line 14 and an inlet opening 11*b* in fluid communication with the refill valve 13 as shown in FIG. 1C. The distal end of the at least one supply line 14 is provided with an opening 14*a*. Depending on the nanoclimate clothing article, the cooling system 10 can comprise a plurality of supply lines 14, each in fluid communication with the outlet valve 11*a*. Alternatively, a plurality of supply lines may be configured to branch off the main supply line 14. The canister 11 is provided with a gas-impermeable surface so that it can contain a cooling agent in a gaseous or vapor state. In a preferred embodiment, the canister 11 is disposed within the side rim 5 of cap 1 as shown in FIG. 1A.

The fundamental functional premise of nanoclimate clothing and apparel is the storage of a gas state cooling agent, which is stored in the impermeable canister 11. By opening the outlet valve 11*a* via regulator 12, the cooling agent is released from the canister 11 and introduced into the at least one supply line 14. The cooling agent passes through the at least one supply line 14 and exits through the opening 14*a*. In this manner, the cooling agent is released within the airspace of the cap 1. The amount of cooling agent flowing from the canister into the at least one supply line is adjusted by the regulator 12. That is, when the regulator fully opens outlet valve 11*a*, a maximum amount of cooling agent will flow from the canister into the at least one supply line. When the outlet valve is less than fully opened, but not closed, a lesser amount of cooling agent will flow into the at least one supply line 14.

The amount of agent released from canister 11 depends upon the cooling agent used and the desired comfort level of the wearer. Any suitable cooling agent that can be stored safely in a gaseous or vapor state is contemplated for use in the present invention. Preferably, the cooling agent is a vapor-based refrigerant. More preferably, the cooling agent is tetrafluoroethane. Tetrafluroethane is a vapor based refrigerant that commonly is used as a propellant in aerosol deodorants and computer keyboard dusters. It is important to note that pharmaceutical tetrafluoroethane blends, such as Dupont's Dymel™, have been approved by the U.S. Food and Drug Administration, are environmentally friendly and safe for human consumption.

Any type of regulator or restrictor valve can be used to control the flow of the cooling agent from the canister 11, as will be well known to those skilled practitioners of the art. Suitable examples of such regulators include screw-based regulators and slide-based regulators. Once the gas- or vapor-state cooling agent is released through the outlet valve, the pressure generated by the cooling agent forces it out of the canister 11 and into the at least one supply line 14. The supply line delivers the cooling agent from the canister to the optimal release point inside nanoclimate clothing article by exit opening 14*a*. As the heat exchange occurs inside the user's clothing and apparel, the cooling effect of the agent is experienced.

To ensure the wearer receives the maximum benefit of the heating or cooling agent, a water-proofing polymer, such as silicone polymer, can be used to coat the fabric of the nanoclimate clothing article, such that the cooling agent does not escape into the atmosphere through pores in the fabric.

Upon expenditure of the cooling agent inside the original agent canister 11, the canister can be recharged with cooling agent through the refill valve 13. In an alternative embodiment shown in FIG. 2, the canister 11 can be removed from the nanoclimate article and replaced with a replacement canister 15. In this embodiment, the canister is attached to the nanoclimate clothing article by suitable securing means, including for example, hook and loop type fastening means, such as Velcro™, a snap-fit arrangement or the like. Alternatively, a pocket 19 can be disposed within the nanoclimate article 1 adapted to receive and retain the canister 11.

In operation, a user places the cap on his head and adjusts the regulator from the OFF position to a desired setting, for example, "low", "medium" and "high". Once the user has attained the optimal level of comfort, the user instantly adjusts the flow of cooling agent by re-setting the regulator to a different position. Upon exhaustion of cooling agent within the canister, the user can replenish the canister with cooling agent via the refill valve attached to the canister, or alternatively, replace the removable canister with a fully charged canister.

Figure 3:
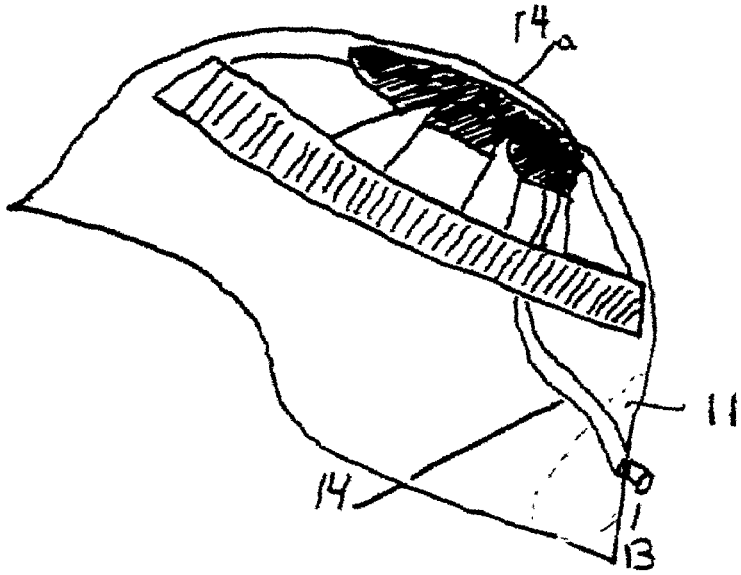
FIG. 3 is a interior side perspective view of a nanoclimate clothing article of the present invention in the form of a hard-hat or military helmet.
Figure 4A:
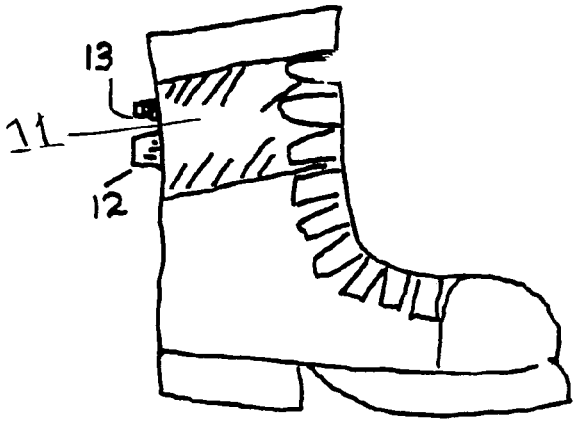
FIG. 4A is a exterior side view of a nanoclimate clothing article of the present invention in the form of a boot.
Figure 4B:
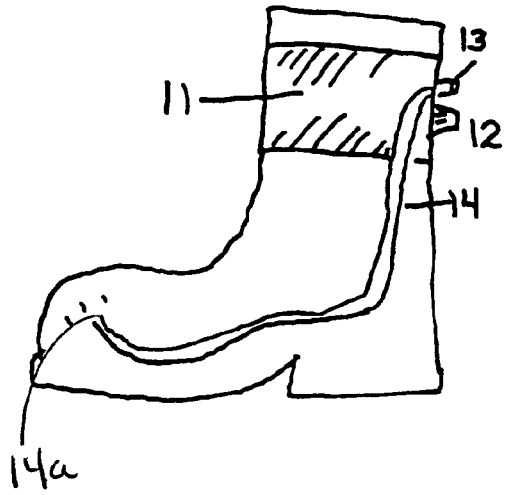
FIG. 4B is a interior side view of a nanoclimate clothing article of the present invention in the form of a boot.
Figure 5:
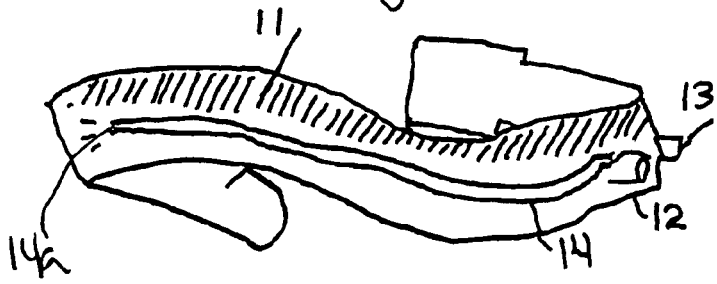
FIG. 5 is a interior side view of a nanoclimate clothing article of the present invention in the form of a belt.
Figure 6:
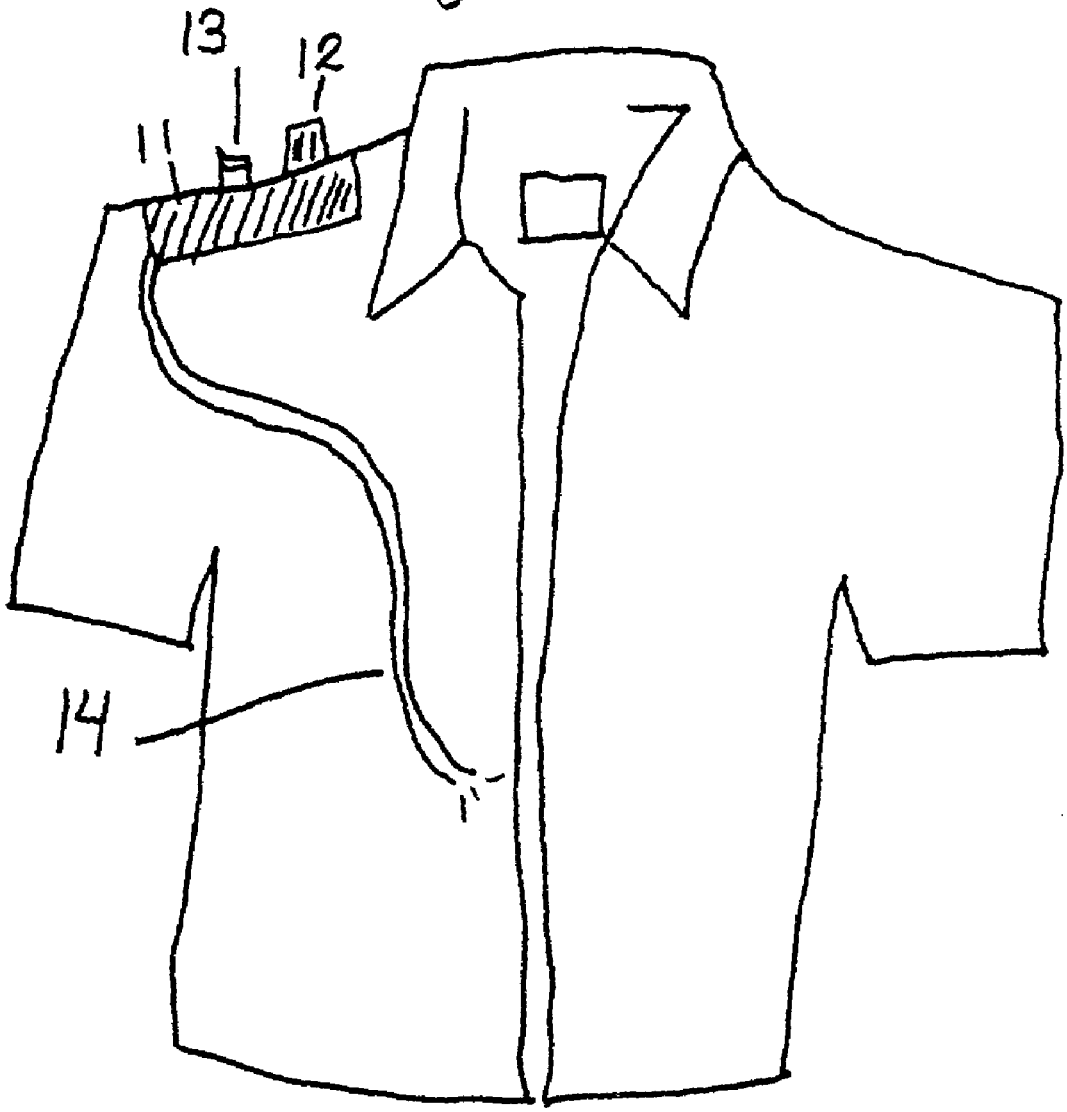
FIG. 6 is an interior side view of a nanoclimate clothing article of the present invention in the form of a shirt and blouse.

The remaining Figures show other types of nanoclimate clothing articles of the present invention. Specifically, FIGS. 3A and 3B show the nanoclimate clothing article in the form of a helmet 20; FIGS. 4A and 4B show the nanoclimate clothing article in the form of a boot; FIGS. 5A and 5B show the nanoclimate clothing article in the form of a belt; and FIG. 6 shows the nanoclimate clothing article in the form of a shirt or blouse. These Figures illustrate that the cooling system of the present invention can be incorporated into any article of clothing. It is to be understood that the location and size of the regulator, canister, refill valve and at least one supply line can and will vary based upon the type of nanoclimate clothing article, its size, use and material composition.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A cooling system adapted to be used with an article of clothing comprising:

a. a canister having an outlet valve, said canister being filled with a cooling agent in its gaseous or vapor state and having a gas-impermeable surface;

b. a regulator connected to said outlet valve, said regulator adapted to open said outlet valve to a plurality of positions and to close said outlet valve, and c. at least one supply line in fluid communication with said outlet valve, said at least one supply line being disposed within an article of clothing and having an open distal end located at an optimal release point, wherein, when said regulator opens said outlet valve, said coolant agent is released from said canister, introduced into said at least one supply line and exits through said open distal end of said at least one supply line, thereby delivering said cooling agent to said optimal release point.

2. The cooling system in accordance with claim 1, wherein said canister is a removable canister which can be replaced with a new canister containing said cooling agent.

3. The cooling system in accordance with claim 1, wherein said cooling agent is a vapor-based refrigerant.

4. The cooling system in accordance with claim 3, wherein said cooling agent is tetrafluroethane.

5. The cooling system in accordance with claim 2, wherein said canister is attached to an article of clothing by securing means.

6. The cooling system in accordance with claim 5, wherein said securing means includes hook and loop type fastening.

7. The cooling system in accordance with claim 1, wherein said canister has an inlet opening and further comprising:

d. a refill valve in fluid communication with said inlet opening.

8. The cooling system in accordance with claim 7, wherein said canister can be recharged with cooling agent by introducing cooling agent through said refill valve.

9. The cooling system in accordance with claim 7, wherein said cooling agent is a vapor-based refrigerant.

10. The cooling system in accordance with claim 9, wherein said cooling agent is tetrafluroethane.

11. The cooling system in accordance with claim 1, wherein said regulator is provided with an OFF position, a LOW position, a MEDIUM position, and a HIGH position in order to adjust the flow of cooling agent to said at least one supply line.

12. The cooling system in accordance with claim 1, wherein said at least one supply line is a plurality of supply lines.

13. A baseball cap adapted to provide the wearer with a cooling environment, said baseball cap comprising:

a. a visor;

b. a crown area having a front area, a rear area and side areas, and c. a cooling system, said cooling system comprising:

(1) a canister having an outlet valve, said canister being filled with a cooling agent in its gaseous or vapor state and having a gas-impermeable surface;

(2) a regulator connected to said outlet valve, said regulator adapted to open said outlet valve to a plurality of positions and to close said outlet valve, and (3) at least one supply line in fluid communication with said outlet valve, said at least one supply line being disposed within said baseball cap and having an open distal end located at an optimal release point within said crown of said baseball cap, wherein, when said regulator opens said outlet valve, said coolant agent is released from said canister, introduced into said at least one supply line and exits through said open distal end of said at least one supply line, thereby delivering said cooling agent to said optimal release point.

14. The cooling system in accordance with claim 13, wherein said at least one supply line is a plurality of supply lines, said open distal end of each of said plurality of supply lines being disposed within said crown of said baseball cap in such a manner that each open distal end is located at an optimal release point.

15. The cooling system in accordance with claim 13, wherein said canister has an inlet opening and further comprising:

d. a refill valve in fluid communication with said inlet opening.

16. The cooling system in accordance with claim 15, wherein said canister can be recharged with cooling agent by introducing cooling agent through said refill valve.

17. The cooling system in accordance with claim 13, wherein said cooling agent is a vapor-based refrigerant.

18. The cooling system in accordance with claim 17, wherein said cooling agent is tetrafluroethane.

19. The cooling system in accordance with claim 13, wherein said regulator is provided with an OFF position, a LOW position, a MEDIUM position, and a HIGH position in order to adjust the flow of cooling agent to said at least one supply line.

20. The cooling system in accordance with claim 1, wherein said baseball cap is coated with a water-proofing polymer.

* * * * *